United States Patent [19]

Hussamy

[11] 4,238,191

[45] Dec. 9, 1980

[54] BULKING OF POLYCARBONAMIDES: QIANA

[75] Inventor: Samir Hussamy, Lynchburg, Va.

[73] Assignee: Burlington Industries, Inc., Greensboro, N.C.

[21] Appl. No.: 97,373

[22] Filed: Nov. 26, 1979

Related U.S. Application Data

[63] Continuation of Ser. No. 659,637, Feb. 20, 1976, abandoned.

[51] Int. Cl.[3] ..... D06M 3/24

[52] U.S. Cl. ..... 8/130.1; 8/925; 8/611 R; 8/DIG. 21

[58] Field of Search ..... 8/93, 130.1, 173, 175, 8/178 R, DIG. 21

[56] References Cited

U.S. PATENT DOCUMENTS

| | | | |
|---|---|---|---|
| T896,012 | 3/1972 | Rufino | 8/130.1 |
| 3,154,374 | 10/1964 | Gruschke et al. | 8/130.1 |
| 3,170,757 | 2/1965 | Gift et al. | 8/55 |
| 3,467,484 | 9/1969 | Hermes | 8/15 |
| 3,510,891 | 5/1970 | Luongo | 8/173 |
| 3,700,405 | 10/1972 | Petite et al. | 8/173 |
| 3,702,229 | 11/1972 | Campana | 8/62 |
| 3,932,128 | 1/1976 | Beaulieu | 8/173 |

OTHER PUBLICATIONS

Du Pont Technical Information Bulletin Q-1, "Dyeing and Finishing Warp Knit Fabrics of Qiana Nylon'—Jun. 1975.

Du Pont Qiana Nylon Bulletin Q-5, "Dyeing and Finishing Fabrics of Type 472 Nylon"—Dec. 1970.

*Primary Examiner*—A. Lionel Clingman

*Attorney, Agent, or Firm*—Cushman, Darby & Cushman

[57] ABSTRACT

A process for bulking linear polycarbonamide fibers which comprises treating the same with a solution or dispersion of an alcohol, thereafter washing in hot and cold water and drying.

7 Claims, No Drawings

BULKING OF POLYCARBONAMIDES: QIANA

CROSS-REFERENCE TO RELATED APPLICATIONS

This is a Continuation of my earlier application Ser. No. 659,637 filed Feb. 20, 1976 and now abandoned.

BACKGROUND OF THE INVENTION

The present invention is concerned with the bulking of linear polycarbonamide fibers.

The fibers with which the invention is concerned are silk-like linear, high molecular weight polyamide fibers wherein at least 90% of the repeating units have the formula

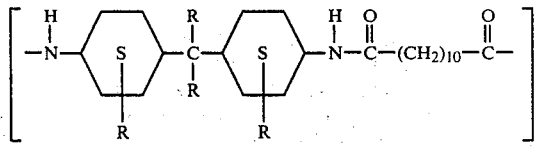

wherein S indicates a saturated cyclohexyl ring and the R substituents, which may be the same or different, are selected from the group consisting of hydrogen and methyl. At least 40% by weight of the diamine constituent of the repeating unit is of the trans-trans (t) sterioisomeric configuration.

Fibers of the above type, and fabric made therefrom, are described in U.S. Pat. No. 3,393,210, the subject matter of which is incorporated herein. Typically, the fibers are made from the polyamide polycondensate of 4,4'-diaminodicyclohexylmethane with dodecanedioic acid. Such material is commercially available (Dupont) depending on finish, denier, etc., as Nylon Types 470, 472, 473 (trademarked as "Qiana"). The latter material has a silk-like handle, a density of 1.04, and a crystallinity similar to polyester fibers as reported by A. Liddiard, Review of Progress in Coloration, Vol. 1, page 64, June '67–September '69.

It is disclosed in DuPont's bulletin on Preparation, Dyeing and Finishing Woven and Warp Knit Fabrics of Type 470, Type 472, and/or T-473 Nylon Filament Yarns, that these fabrics can be thermally bulked and stabilized in the greige state or after being scoured and dried, either on an externally taperable pin tenter frame, or on a rational hot roll contact unit, or similar type machines. However, heat bulking as such tends to yellow the "Qiana", renders it more difficult to dye, and does not help develop the silk-like handle of the fabric to its fullest degree.

The principal object of the present invention is to provide a process for bulking fabrics made from fibers of the type indicated above (Type 470, Type 472 and/or Type 473 Nylon filament yarn "Qiana") which obviates prior art problems and positively develops the silk-like handle of these fabrics to their fullest degree and renders them easier to dye, with a minimum of adverse modification of the fibers.

Other objects will also be apparent from the following more detailed description of the invention.

DESCRIPTION OF THE INVENTION

Broadly stated, the objects of the invention are realized by treating a textile substrate, notably a knit or woven fabric, comprising silk-like linear, high molecular weight polycarbonamide fibers in which at least 90% of the repeating units have the formula

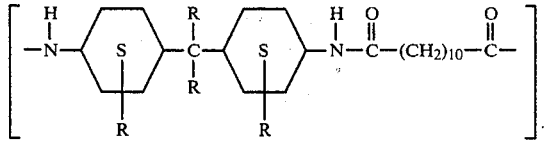

where R is hydrogen or methyl as stated above, with an aqueous or non-aqueous solution or dispersion containing 1–100% by weight of one or more aromatic or aliphatic alcohols, followed by washing in hot and cold water and then drying.

The dyeing of "Qiana" fibers using a dyebath containing an alcohol is described in U.S. Pat. No. 3,700,405. Printing "Qiana" fibers using anionic dyes and a carrier therefor which may be an alcohol is also disclosed in U.S. Pat. No. 3,702,229. Treatment of "Qiana" fabrics with alcohols for the purpose of bulking the fabric, as a preliminary to dyeing, is not disclosed in these patents.

The present process may be applied to any type of woven or knit fabric consisting entirely or in substantial part (e.g. 35% by weight or more) of fibers as described above. These fibers may vary widely in denier and length and may be in continuous filament or staple form.

Advantageously the process is carried out by treating the dry fabric in the prescoured or scoured, undyed condition, and in the relaxed state, into a bath which contains one or more of the indicated alcohols. The bath should contain at least 1% by weight of the alcohol and may consist entirely of the alcohol. The alcohol may be dissolved or emulsified in water or some other liquid vehicle which is inert to the fabric and easily removed therefrom. Appropriate emulsifying agents may also be included in the bath to emulsify the alcohol.

A wide variety of aliphatic (including cycloaliphatic) and aromatic alcohols may be used in the present process. Examples of such alcohols include the saturated aliphatic, monohydric and polyhydric alcohols such as methyl, ethyl, n-propyl, isopropyl and n-butyl, isobutyl, sec-butyl, t-butyl, n-amyl, n-hexyl, n-heptyl, n-octyl, capric, n-decyl, lauryl, myristyl, cetyl or stearyl alcohol, ethylene glycol or cyclohexanol; unsaturated alcohols such as allyl alcohol; aromatic alcohols such as benzyl alcohol, phenethyl alcohol, 1-phenyl-1-propyl alcohol, 2-phenyl-2-propyl alcohol, 3-phenyl-1-propyl alcohol; furfuryl alcohol, and alcohols having one of the following formulae:

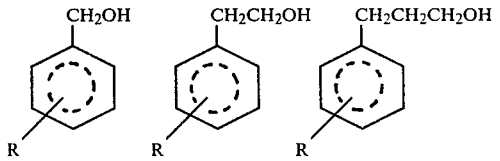

wherein R is a member of the class consisting of halogen, hydroxyl, amino, nitro, alkyl, —$CH_2OH$, —$CH_2CH_2OH$, and —$CH_2CH_2CH_2OH$.

The treatment with alcohol can be carried out at various temperatures. Advantageously the bath is kept at room temperature (20°–25° C.) although elevated temperatures, preferably below the boiling point, may be used.

The duration of the treatment with alcohol can also be varied over a relatively wide range. The time is normally selected for any particular situation to optimize the bulking and other desired properties. Usually this can be accomplished in a period of 1–10 minutes although longer and shorter times may also be used if desired.

After the treatment with alcohol, the fabric is washed in hot water (e.g. at 40° to 100° C.) and then in cold water (e.g. 10° to 20° C.). The washed fabric is thereafter dried in any convenient fashion (e.g. by hot air drying in the relaxed state) to give the desired bulked product.

EXAMPLES OF THE INVENTION

The invention is illustrated, but not limited, by the following examples wherein parts are by weight unless otherwise stated.

EXAMPLE 1

An aqueous emulsion was prepared by vigorously mixing 700 parts water, 270 parts phenethyl alcohol, 30 parts Atlas G3406F. A DuPont Nylon Type 470/472 prescoured knit fabric was introduced into the bath and treated for 1–5 minutes at 20° C., washed in hot and cold water, and then dried. The fabric was bulked. Atlas G3406F emulsifier is an emulsifying agent which may be chemically identified as an anionic-nonionic blend of selected surfactants (that is, sulfonated aromatic and ethoxylated esters with organic solvent).

EXAMPLE 2

A DuPont Nylon Type 472 prescoured woven fabric was treated in a bath containing 100% ethylene glycol for 1–5 minutes at room temperature (20° C.), washed in hot and cold water and then dried to give a bulked fabric.

EXAMPLE 3

A DuPont Nylon Type 470 prescoured woven fabric was treated in a bath containing 100% isopropanol for 1–5 minutes at room temperature (20° C.), washed in hot and cold water and then dried to give a desirably bulked fabric. The fabric is characterized by its excellent silk-like handle and may be very effectively dyed with conventional type dyes using normal dyeing methods.

It will be appreciated that various modifications may be made in the invention as described above. Accordingly, the scope of the invention is defined in the following claims.

I claim:

1. A process for permanently bulking and stabilizing as well as developing the silk-like handle of linear polycarbonamide fibers consisting essentially of sequential steps of:

(1) treating linear polycarbonamide fibers, wherein 90% of the repeating unit in said fibers have the formula:

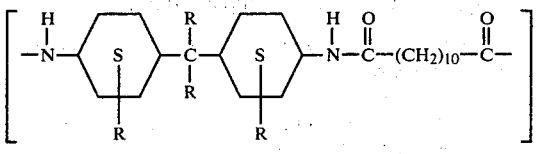

wherein R is hydrogen or methyl, with a solution or emulsion of an alcohol;

(2) washing the fibers in hot water;

(3) washing the fibers in cold water;

(4) drying the washed fibers; and thereafter (5) dyeing the thus-bulked and stabilized fibers.

2. The process of claim 1 wherein said solution or dispersion contains 1–100% by weight of said alcohol.

3. The process of claim 2 wherein said alcohol is selected from the group consisting of aromatic and aliphatic alcohols.

4. The process of claim 1, wherein said fibers are treated with said solution or emulsion for a period of about 1 to about 10 minutes.

5. The process of claim 1, wherein said solution or emulsion of an alcohol is kept at a temperature of from about 20° to about 25° C.

6. The process of claim 1, wherein said fibers are washed in hot water at a temperature of from 40° to 100° C. and thereafter cool water at a temperature of from 10° to 20° C.

7. A process for permanently bulking and stabilizing as well as developing the silk-like handle of linear polycarbonamide fibers which comprises treating linear polycrabonamide fibers wherein 90% of the repeating unit in said fibers have the formula:

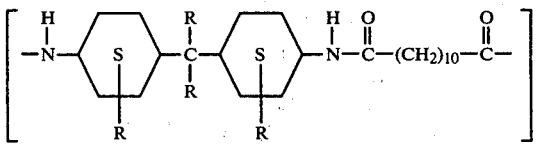

wherein R is hydrogen or methyl with a solution or emulsion of an alcohol, said solution or emulsion being substantially devoid of dyestuff, thereafter washing in hot and cold water and drying.

* * * * *